US006421984B1

(12) United States Patent
Murgatroyd et al.

(10) Patent No.: US 6,421,984 B1
(45) Date of Patent: Jul. 23, 2002

(54) HIGH SPEED LINEAR BAGGING MACHINE AND METHOD OF OPERATION

(75) Inventors: John Murgatroyd, Glusburn Keiguly; W. A. Whitehill, Halifax, both of (GB); Rick Savoury, Markham (CA)

(73) Assignee: Glopak, Inc., Montreal (CA)

( * ) Notice: Subject to any disclaimer, the term of this patent is extended or adjusted under 35 U.S.C. 154(b) by 0 days.

(21) Appl. No.: 09/508,312

(22) PCT Filed: Apr. 21, 1998

(86) PCT No.: PCT/CA98/00303

§ 371 (c)(1),
(2), (4) Date: Mar. 9, 2000

(87) PCT Pub. No.: WO99/54206

PCT Pub. Date: Oct. 28, 1999

(51) Int. Cl.[7] ..... B65B 43/26

(52) U.S. Cl. ..... 53/468; 53/459; 53/496; 53/570; 53/284.7

(58) Field of Search ..... 53/459, 448, 468, 53/57, 493, 496, 570, 255, 249, 284.7; 318/614, 653, 804

(56) References Cited

U.S. PATENT DOCUMENTS

| | | | | |
|---|---|---|---|---|
| 3,451,192 A | | 6/1969 | Irwin | |
| 3,881,410 A | * | 5/1975 | Shenoha | 101/41 |
| 4,671,048 A | | 6/1987 | Rademacher | |
| 5,511,364 A | * | 4/1996 | Levi et al. | 53/570 |
| 5,743,071 A | * | 4/1998 | Wolthuizen | 53/571 |
| 5,941,053 A | * | 8/1999 | Kotsiopoulos | 53/435 |
| 5,954,323 A | * | 9/1999 | Emigh et al. | 270/58.06 |

FOREIGN PATENT DOCUMENTS

| | | |
|---|---|---|
| EP | 0 764 584 A2 | 3/1997 |
| GB | 2 287 925 A | 10/1995 |
| NL | 1 001 892 | 4/1997 |

* cited by examiner

*Primary Examiner*—John Paradiso
(74) *Attorney, Agent, or Firm*—Carter & Schnedler, P.A.

(57) ABSTRACT

A high speed linear bagging machine and method of bagging a product with such machine is described. The machine has a reciprocating linear bagger assembly which has a straight drive member with a carriage connected thereto. A drive having a pair of coils is used to drive the straight drive member to displace the carriage. A stroke controller is used to control the coils dependent on a desired forward and rearward displacement stroke of a carriage along the drive member. A product receptacle is secured to the carriage and displaceable to a bagging station. A bag engaging member is connected to the carriage and a product arresting member is displaceable for abutting relationship with an end of a product at the bagging station. The bag engaging means engages an open end of a bag at a forward end of the displacement stroke adjacent the bagging station and withdrawing the open end of the bag over the product which is maintained substantially stationary by the product arresting means during a reverse stroke of a carriage whereby to insert the product in the bag and discharge the bagged product. The drive member is comprised of a straight thrust rod of magnetic material which constitutes a stator of the linear motor. The pair of coils are connected to the carriage and energized for displacing the carriage along the thrust rod to cause displacement of the carriage.

27 Claims, 7 Drawing Sheets

HIGH SPEED LINEAR BAGGING MACHINE AND METHOD OF OPERATION

TECHNICAL FIELD

The present invention relates to a high speed linear bagging machine and particularly a machine for placing a plastic bag over a sliced loaf of bread.

BACKGROUND ART

In particular, the present invention is an improvement of PCT Application WO94/27867 published on Dec. 8, 1994. The packaging equipment as described in that patent was designed for the automatic packaging of sliced bread in loaf form and wherein the apparatus would operate automatically thereby reducing the labor costs associated with the packaging of sliced bread whilst at the same time reducing labor costs and minimizing contact between laborers and the bread loaf being packaged, this latter advantage being very significant. In particular that machine was concerned with the method of holding a sliced loaf of bread in position and pulling an open bag thereover and then releasing the bag to a bag closing station.

Prior to that PCT and as described in U.S. Pat. No. 4,457,124, the machines comprised of delivering loaves of bread to a loading station where a pusher would push the loaf of bread into a bag and then create a vacuum to draw air out of the bag. A sealing device then sealed the bag and the pusher releases the bag so that a conveyor could carry the bag away from the machine. It is pointed out that all of this known prior art machinery utilized complicated drives and mechanical cams and gears to time and position the components used to bag the bread in a non-stationary scoop type bread bagger. These designs required frequent mechanical adjustments to the infeed conveyor flights to accommodate different loaf sizes and the scoop position/timing could not be optimized for different loaf sizes. The basic machine cycle was fixed relative to its position in time by mechanical pneumatic devices and fixed ratio drives were utilized. Furthermore, the infeed conveyor and the discharge conveyor were provided with separate drives and because of their mechanical mechanisms frequent adjustments were necessary to try to synchronize their drives and it became more difficult to then synchronize the associated reciprocating bagger device which either pushed the loaf into the bag or drew the bag over the loaf.

Another disadvantage of prior art machines is that because of their complex drive and mechanical structures, the machines were subjected to vibrations which destabilized the bag engaging mechanism and this made it difficult for the bag engaging elements to consistently engage a bag and draw it over the loaf as this mechanism required high precision. This caused machine malfunctions and frequent stoppages thereby requiring constant supervision, which is not the intent of such apparatus. In an attempt to circumvent this problem, additional bracing of the frame was necessary and this resulted in machines which were fairly large and not compatible with other machines.

Another drawback of prior art machines is that they are not versatile to adapt to various types of bag formers or bag storing wicket assemblies which often cannot be located at a precise location required by the bag engaging device. Accordingly, there was a restriction on the type of bag supplying equipment that could be used with different types of bagging machines.

A still further disadvantage of the prior art equipment is that they cannot operate accurately at high speed. High speed, with respect to bagging a sliced bread is defined as a handling rate of one bag per second or slightly better. Because the three stations associated with prior art machines are independently operated, this makes it very difficult to obtain precision and machine stability at these high bagging rates of between 60 to 80 loaves per minute.

DISCLOSURE OF INVENTION

It is a feature of the present invention to provide a high speed linear bagging machine and method of operation which substantially overcomes the above-mentioned disadvantages of the prior art.

Another feature of the present invention is to provide a high speed linear bagging machine and method of operation which is adjustable and programmable to handle bread loaves of different sizes and bags also of different sizes and wherein the infeed conveyor, the discharge conveyor and the reciprocating high speed linear bagger are all synchronized to one another.

Another feature of the present invention is to provide a high speed linear bagging machine which has a lower center of gravity than the prior art machines and wherein the machine is compatible with other associated machines such as bag formers and bag closing machines and wherein the problem of vibration is substantially reduced thereby making the machine very reliable and substantially free of the above-mentioned malfunctions of prior art machines thereby greatly reducing the cost of operation.

Another feature of the present invention is to provide a high speed linear bagging machine which is provided with an automated control system providing for the preprogramming of machine parameters.

Another feature of the present invention is to provide a high speed linear bagging machine wherein the reciprocating linear bagger is provided with an adjustable stroke length to adapt the machine with various bag forming equipment or bag delivery equipment.

Another feature of the present invention is to provide a high speed linear bagging machine having a reciprocating linear bagger and wherein at least one of the scoops of the bagger is displaceable to positively engage the bag and stretch it with a predetermined pressure and to draw it over the sliced loaf while maintaining the sliced loaf in a stable condition.

Another feature of the present invention is to provide a high speed linear bagging machine wherein the infeed and discharge conveyors are synchronized through a common drive and wherein the bread conveying elements may be adjusted to adapt to bread loaves of different sizes to synchronize same with the reciprocating linear bagger.

According to the above features, from a broad aspect, the present invention provides a high speed linear bagging machine which comprises a product carrying infeed conveyor for transporting a product to be bagged to a bagging station. A discharge conveyor is provided adjacent the bagging station for transporting a bagged product. A reciprocating linear bagger assembly having a straight stator slide and a carriage connected to a pair of coils is displaceable along the stator slide. Stroke control means is further provided for controlling the coils and dependent on a desired forward and rearward displacement stroke of the carriage along the slide. A product receptacle is secured to the carriage and displaceable to the bagging station. Bag engaging means is connected to the carriage. Product arresting means is displaceable for abutting relationship with the product at the bagging station. The bag engaging means engages an open end of a bag at a forward end of the displacement stroke adjacent the bagging station and withdraws the open end of the bag over the product which is maintained substantially stationary by the product arresting means during the reverse stroke of the carriage whereby to insert the product in the bag and discharge the bagged product from the product receptacle. Detection means is associated with the infeed conveyor and the control means to detect the position of the product. The infeed and discharge conveyors have a common synchronized drive feeding a speed indicator signal to the control means to synch the reciprocating linear bagger with the conveyors.

According to a still further broad aspect of the present invention there is provided a method of bagging a product comprising the steps of transporting a product to be bagged on an infeed conveyor to a bagging station. The product is detected and a control means is fed a signal to indicate the position of the product prior to the product reaching the bagging station. A reciprocating linear bagger is displaced along a straight stator slide through a predetermined forward stroke to position a product receptacle at the bagging station to receive the product thereon and to simultaneously engage an open end of a bag at a bag dispensing station by a pair of arm elements. The open end of the bag is tensioned by applying regulated pressure to an articulated one of the arm elements. A product arresting means is disposed in abutting relationship with a first end of the product discharged on the product receptacle and disposed axially opposite to the engaged bag open end. The reciprocating linear bagger is then displaced through a predetermined rearward stroke to draw the open end of the engaged bag over the product from an opposed end of the product. The bag product is then discharged on a discharge conveyor and the product arresting means is withdrawn from its arresting position with the product.

BRIEF DESCRIPTION OF THE DRAWINGS

A preferred embodiment of the present invention will now be described with reference to the accompanying drawings in which.

MODES FOR CARRYING OUT THE INVENTION

Figure 1:
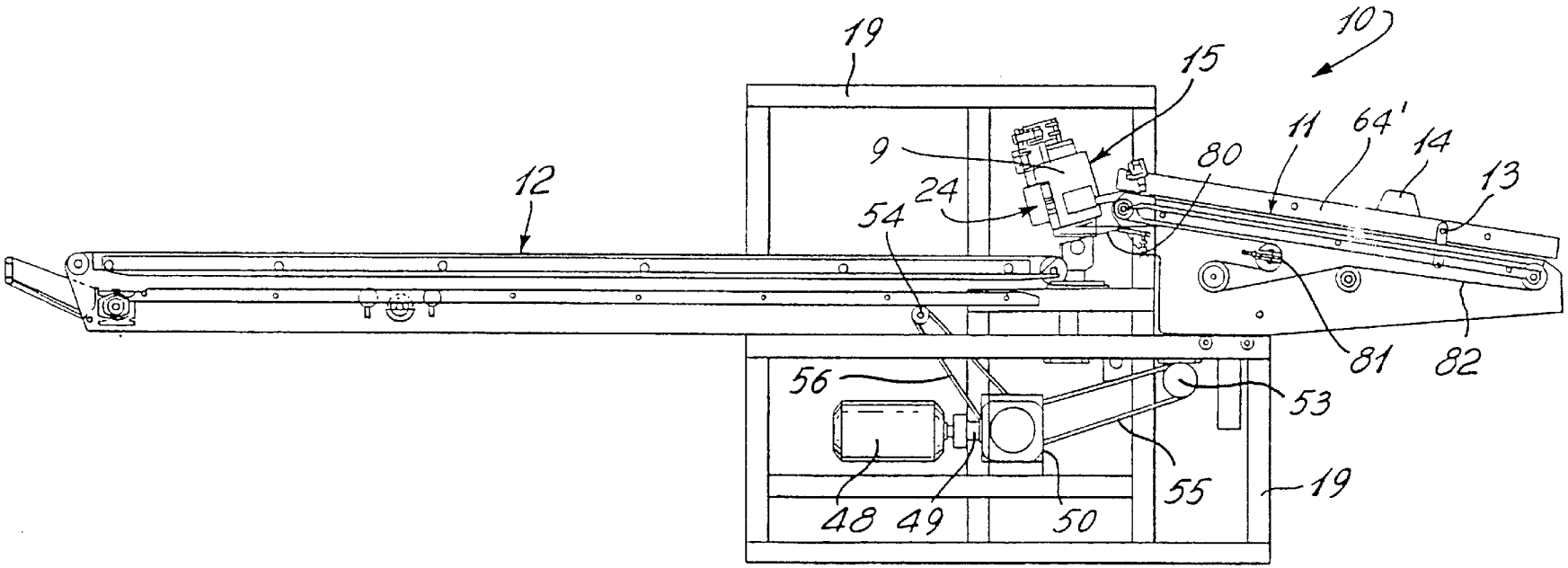
FIG. 1 is a side view of the infeed and discharge conveyors showing their interconnected drive and the position of the reciprocating linear bagger and indicating the position of the product receptacle in relation to the infeed and discharge conveyors.
Figure 2A:
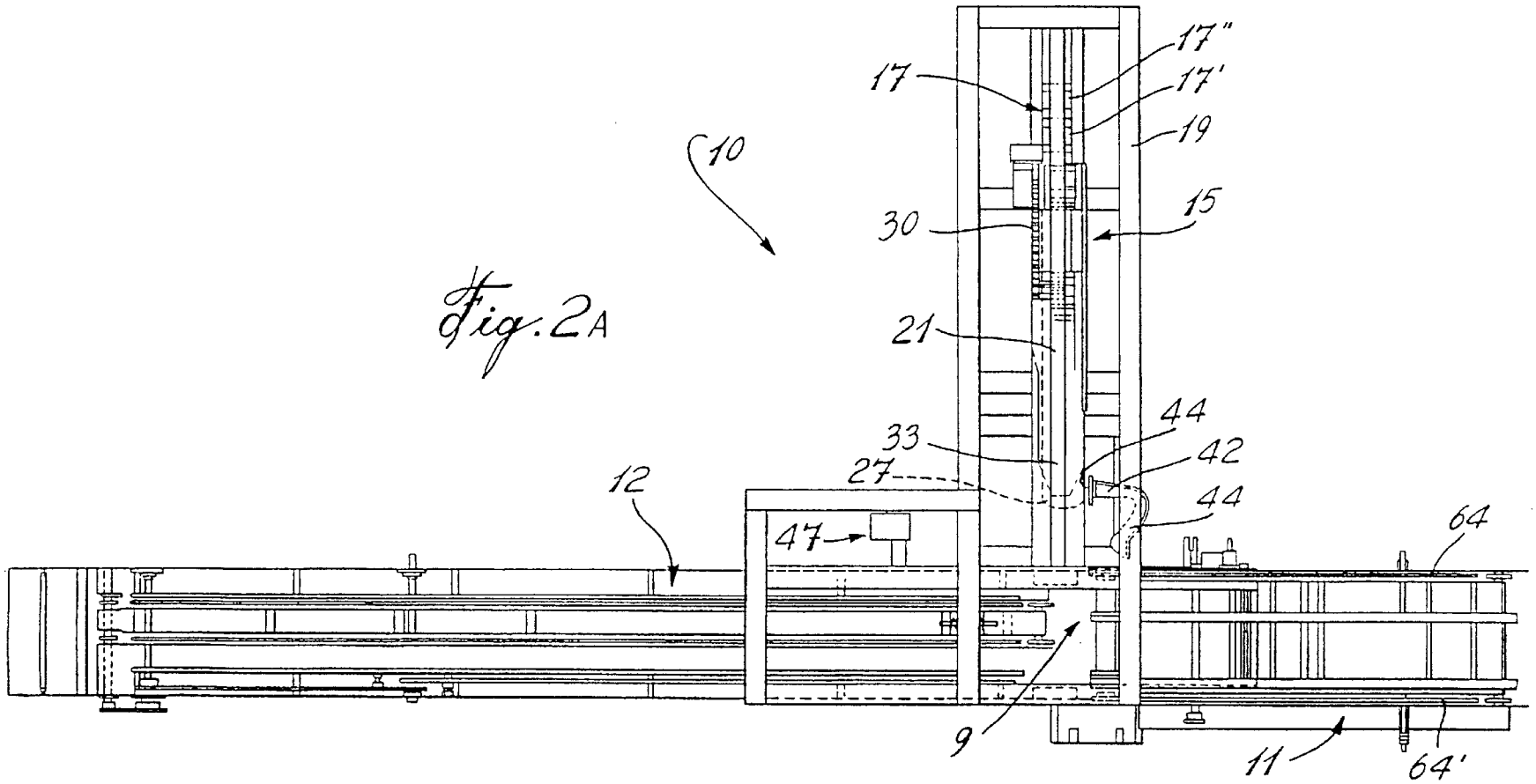
FIG. 2A is a top view of FIG. 1 and particularly illustrating the disposition of the reciprocating linear bagger in relation to the infeed and discharge conveyor as well as the position of the pneumatic blockade assembly.
Figure 2B:
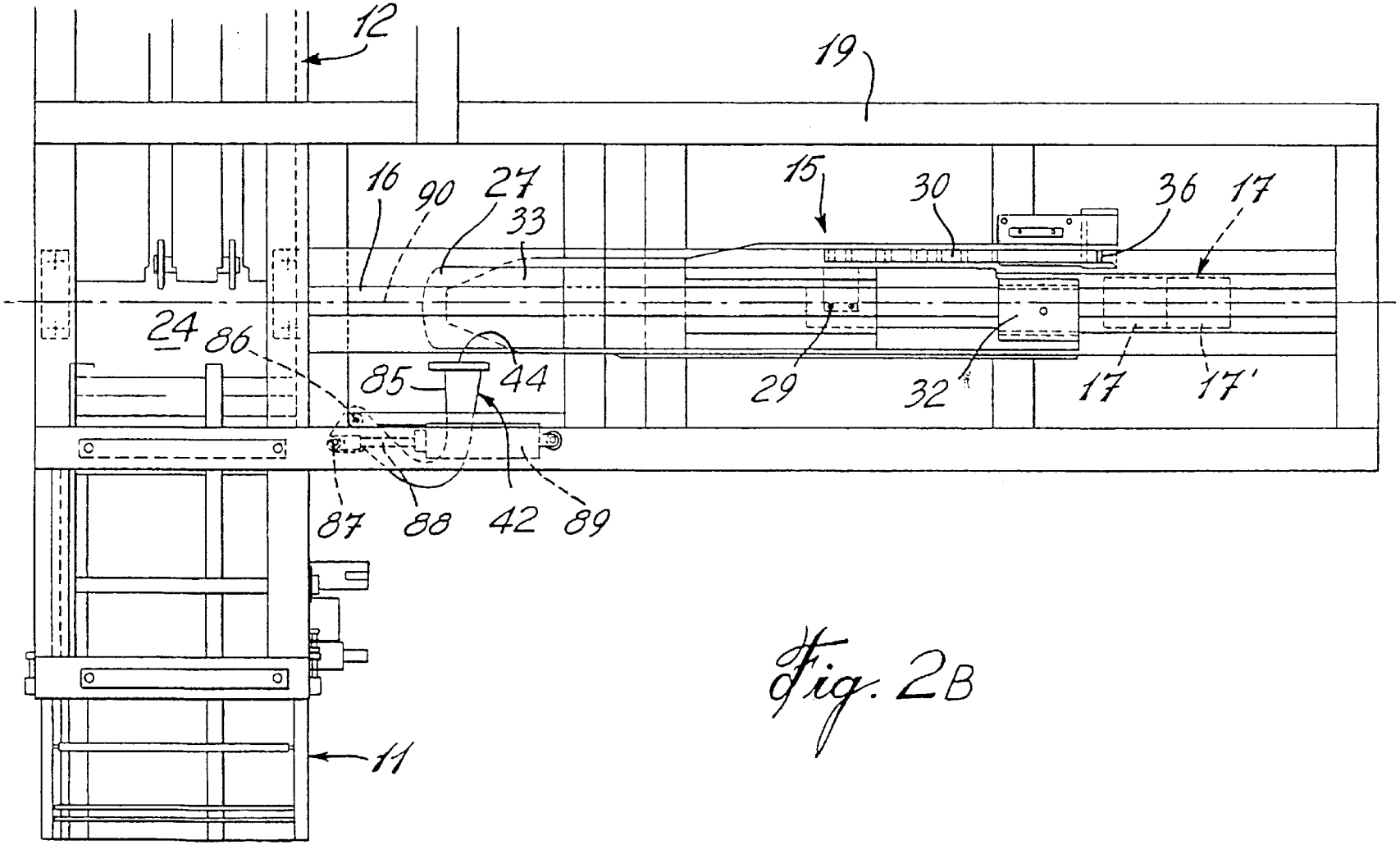
FIG. 2B is an enlarged top view showing the position of the reciprocating linear bagger with respect to the bag loading position and the infeed and discharge conveyors with the pneumatic blockade assembly being shown in greater detail.

Referring now to the drawings and more particularly to FIGS. 1 and 2, there is shown generally at 10 the high speed linear bagging machine of the present invention and herein including a linear bagger assembly 15, an infeed conveyor 11 and a discharge conveyor 12. The infeed conveyor 11 is provided with pusher rods 13 which convey a product, herein a loaf of sliced bread 14, to a bagging station 9.

As seen more clearly in FIGS. 2A to 4, the bagging machine 10 comprises a reciprocating linear bagger assembly 15 which is herein displaceable on a straight slide support rod 16. The slide support rod 16 is a magnetic stator of a linear drive device 7. The linear drive device is provided with a thrust block 17 displaceable on the rod 16 by two electric coils 8 and 8' and housed in the housings 17' and 17", thereunder (see FIG. 2B). The thrust block 17 herein constitutes a carriage for the reciprocating linear bagger 15. By controlling the current through one of the coils the carriage is displaced in a forward stroke and by controlling the current in the other coil it is displaced through a rearward stroke. The length of the stroke is determined by the application time of the current and it is pointed out that such linear drives can operate at speeds up to two complete cycles per second. The length of the forward and rearward stroke is preprogrammed in a controlled unit 18 which is conveniently mounted on the frame 19 of the machine. The control panel is connected to a computer control circuit (not shown herein) and which processes various signals received from sensors or information which is keyed directly into the computer, and not shown herein. Through the control panel and its computer, the machine can be programmed to adapt to different parameters, such as bag size, loaf size, feed and bagging speeds, and location of accompanying bag forming and dispensing equipment.

The reciprocating linear bagger assembly 15 further comprises a pair of spaced apart arms, herein a lower arm 20 and an upper arm 21 which are secured to the carriage 17 in the following manner. As hereinshown the lower arm 20 is provided with a bracket 22 to adjustably secure same to the piston block 23. The lower arm also delineates a product receptacle 24 formed by a lower horizontal plate section 25 and a transverse abutment plate 26. The lower horizontal plate extends at a forward end to define a lower scoop section 27. The receptacle 24 is inclined rearwardly as illustrated in FIG. 1.

The upper arm 21 is also provided with a bracket 28 which is adjustably secured by the slots and bolts 29 to a free end of a rocker arm 30. The rocker arm 30 is pivotally connected at 31 to the top end of a support 32 which is connected to piston rods 33 whereby the support 32 and the upper arm 21, which is also provided with an upper scoop section 33, may be positioned inside a mouth of an open bag and displaced to a bag extending position, the latter being shown in FIG. 3. A piston 34 is also connected to the support 32 and has its piston rod 35 connected at an opposed end 36 of the rocker arm 30. When the piston 34 is actuated it will draw the piston rod 35 a predetermined distance depending on the pressure applied to the piston 34 whereby to articulate the rocker arm on the pivot connection 31 to hinge the upper scoop section 33 upwardly whereby to stretch the open mouth 39 or the open end of a plastic bag 40 supported at a bagging station 41 as shown in FIG. 4.

Figure 3:
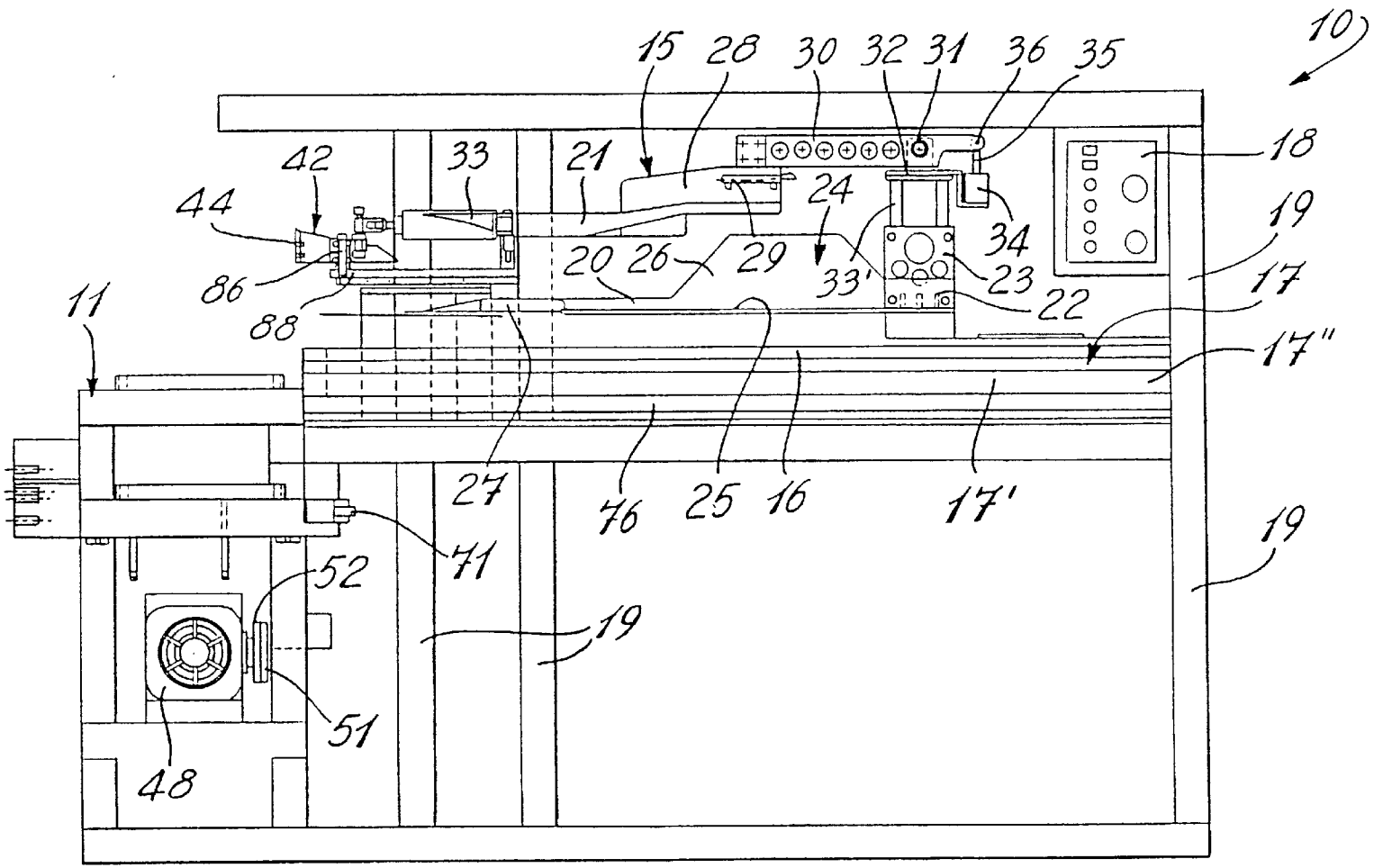
FIG. 3 is an end view of the machine as illustrated in FIGS. 1 and 2 but showing in more detail the construction of the reciprocating linear bagger with the carriage located at a withdrawn position.
Figure 7:
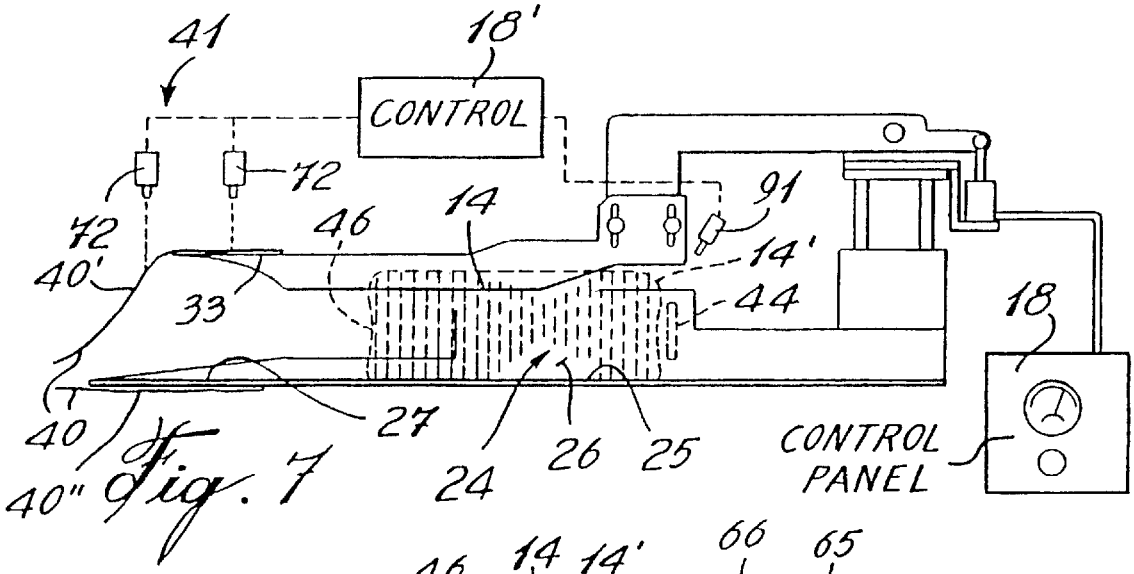
FIG. 7 is a schematic view showing the adjustability of the scoop assembly associated with the linear bagger.

As shown in FIGS. 2, 3 and 7, a blockade assembly 42 is secured to the frame 19 and disposed adjacent the bagging station 9 and it constitutes a product arresting means which is displaceable on a pivot connection 43 for displacing its abutment plate 44 with an end 14' of the sliced bread loaf 14 when the bread loaf is discharged in the product receptacle 24, as shown in FIG. 3, when the receptacle is disposed at the bagging station 9.

Figure 4:
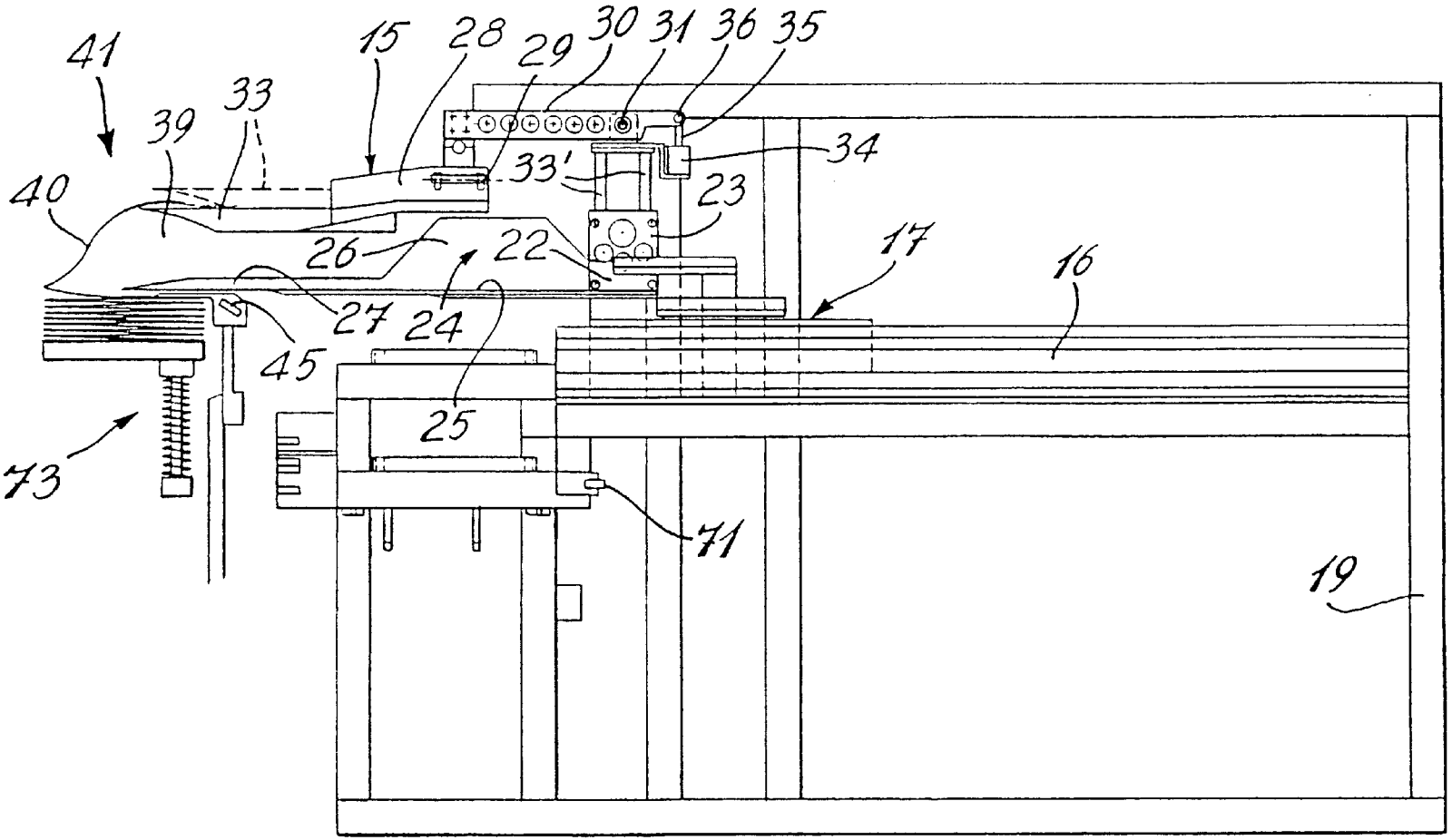
FIG. 4 is an end view similar to FIG. 3 but showing the carriage of the reciprocating linear bagger at its product receiving and bag engaging position.

As previously described and with particular reference to FIG. 4, the reciprocating linear bagger 15 is displaced through a forward stroke and at a predetermined distance in this forward stroke the lower scoop section 27 and upper scoop section 33 will enter the end of the bag which has been opened by blowing air into the open mouth of the bag by means of an air jet 45 located adjacent thereto. Once the scoops are entered into the open end of the bag, the piston rods 33 are extended, as shown in FIG. 4, causing the upper scoop to fully open the bag. However, in order to apply tension to prevent the bag from slipping out of engagement with the scoops, during the reverse stroke of the reciprocating linear bagger 15, the piston 34 is actuated with a predetermined air pressure to cause the upper scoop 33 to tilt upwards whereby to stretch the bag a predetermined amount. By controlling the air pressure in the piston 34 we can control the amount of stretching applied to the bag and this will depend on the size of the bag and the material from which it is constructed. The stretching provides positive engagement which is very important for the continuous uninterrupted operation of the bagger.

It is pointed out that when the bagger initiates its reverse stroke at high speed, air which has been blown into the bag by the air jet 45 will offer some resistance against the outer end 46 of the product 14, as shown in FIG. 7. Therefore the bag needs to be positively engaged to overcome this resistance. This air pressure against the end 46 of the sliced loaf 14 prevents the end slices from falling. As previously described, the abutting plate 44 of the blockade assembly 42 abuts the other end 14' of the loaf and accordingly the sliced bread is maintained intact during the bagging operation.

With further reference to FIG. 7, it is also pointed out that during the reverse stroke and as the bag is placed over the sliced loaf 14, the lower horizontal plate section 25 is retracted with the sliced bread 14 remaining substantially stationary. When the lower scoop 27 clears the abutting plate 44, the bagged loaf 14 is discharged onto the discharge conveyor 12 where the open end of the bag is fed through a bag closure station 47 to secure the open end of the bag. The bag closure station 47 is schematically illustrated in FIG. 2 and it utilizes equipment well known in the art either to apply a twisted wire or a plastic closure tab to the bag open end.

Referring again to FIG. 1 it can be seen that the infeed conveyor 11 and the discharge conveyor 12 are both driven by a common motor 48 having its output drive shaft 49 connected to a gear box 50. A pair of drive sprockets 51 and 52, shown in FIG. 3, provide the drive for the drive sprockets 53 and 54 associated respectively to the infeed conveyor 11 and discharge conveyor 12 through chain drives 55 and 56, respectively.

Figure 5:
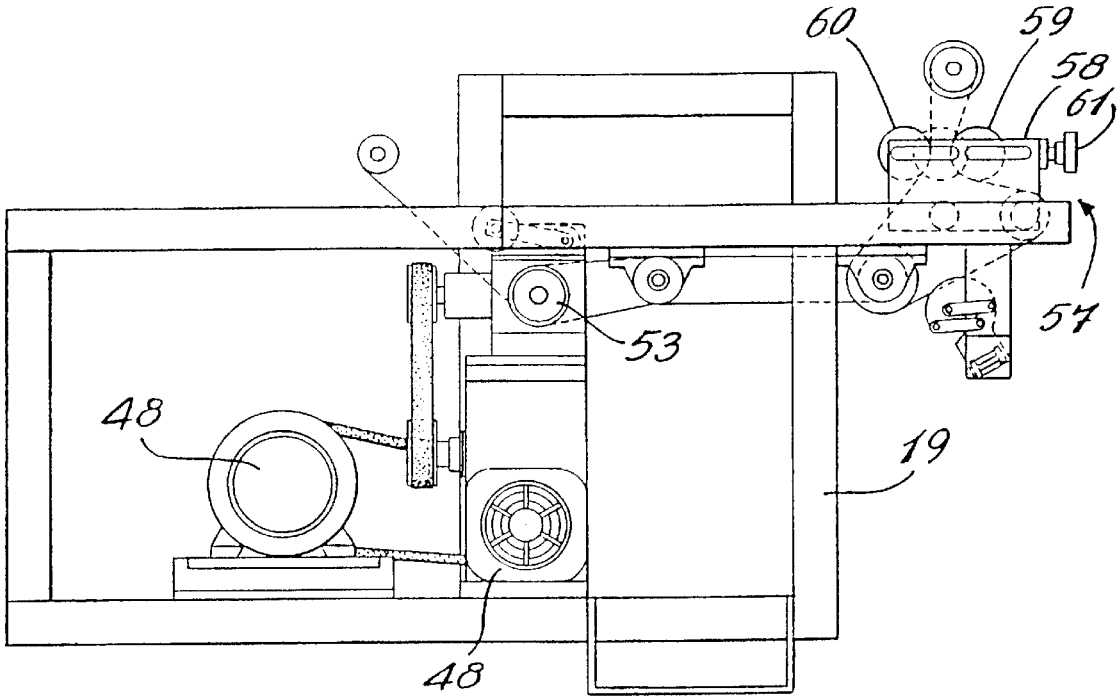
FIG. 5 is a side view showing the construction of an infeed phase adjuster associated with the infeed conveyor to provide adjustment to handle loaves of different sizes for synchronizing with the reciprocating linear bagger.
Figure 8:
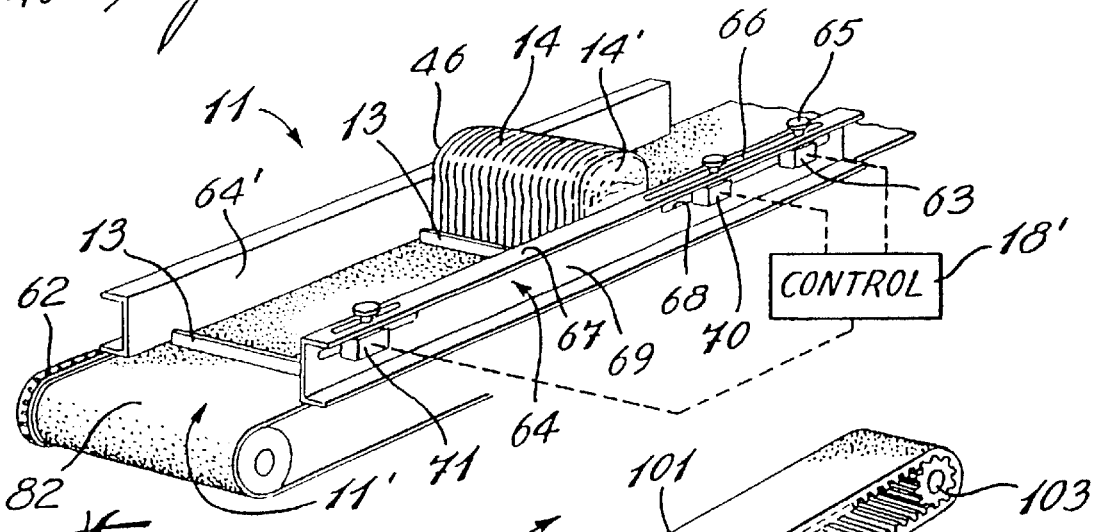
FIG. 8 is a simplified fragmented perspective view illustrating the detecting sensors associated with the infeed conveyor for synchronizing the product to be bagged with the reciprocating linear bagger.

As shown in FIG. 5, the infeed conveyor is further provided with a phase adjuster mechanism 57 whereby to provide proper adjustment of the pusher rods 13, see FIG. 8, with the product discharge location at the bagging station 9 whereby to synchronize same, through the control panel 18, with the reciprocating linear bagger 15 so that the product receptacle 24 is positioned to receive the loaf being discharged at the precise moment of its discharge. The phase adjusting mechanism 57 comprises a frame 58 on which a pair of sprockets 59 and 60 are displaceable in tandem to adjust the position of the pusher bars 13 at the discharge end of the infeed conveyor for discharge in the receptacle 24. The adjusting knob 61 provides approximately 2 inches of adjustment of the pusher rods which are connected between link chains 62, as shown in FIG. 8.

As also shown in FIG. 8, detection means is also associated with the infeed conveyor 11 and it comprises a first sensor 63 which is adjustably connected to the adjustable guide wall 64 by means of a fastener assembly 65 displaceable along a slot 66 provided in a top wall 67 of the guide wall 64. A further slot 68 is provided in the side wall 69 of the guide wall 64 whereby the detecting beam of the sensor can detect the forward edge of the sliced bread loaf 14 being conveyed on the infeed conveyor 11 and between the opposed guide walls 64 and 64' which are both made adjustable. These guide walls are adjusted whereby the loaf 14 will be discharged at a precise location on the product receptacle 24 slightly ahead of the abutting plate 44, as shown in FIG. 7. The first sensor 63 sends a signal to the control circuit 18', which as hereinabove described is a computer and it provides for the initiation of the forward stroke of the linear bagger. Each time the forward edge of subsequent loaves 14 are detected by the sensor 63 the forward stroke of the linear bagger is initiated.

The detection means further comprises a second sensor 70 which is secured in a like fashion as with the sensor 63 but upstream of the infeed conveyor 11 to also detect a leading edge of the article, herein, the loaf of sliced bread 14, and its purpose is to actuate the air jet 45 at the bagging station 41 to cause a bag retained at the bagging station to be open prior to the scoops arriving to engage the open end of the bag. Its signal is also connected to the control computer 18'.

A still further detecting means in the form of a third sensor 71 is also secured to the side wall 69 of the guide wall assembly 64 and adjacent the receiving end 11' of the infeed conveyor 11 and it also sends a signal to the control computer 18' which in turn controls the speed of an article feeding machine, not shown, which is a bread slicing machine. Accordingly, the bread slicing machine is also synchronized with the infeed conveyor 11. Usually, a bread slicing machine can operate at a slicing speed of approximately up to 2 loaves per second. It can therefore be appreciated that to achieve high speed bagging, it is extremely important that the slicing machine, the infeed conveyor, the reciprocating linear bagger and the discharge conveyor as well as the operation of the bagging station all be precisely synchronized. This is achievable with the apparatus of the present invention.

Referring again to FIG. 7 it can be seen that a still further sensor 72, herein a proximity sensor, is provided at the bagging station 41 whereby to detect that the side wall 40' of the bag 40 is in fact engaged by the scoops 27 and 33. This sensor 72 also feeds a signal to the control computer 18' and if the bag side wall 40' is not present the high speed linear bagging machine 10 and its associated bread slicer (not shown) will be automatically stopped so that the bag dispensing problem can be corrected or a new supply of bags carried by another wicket assembly, such as shown at 73 in FIG. 4, can be repositioned at the bagging station 41.

Figure 6:
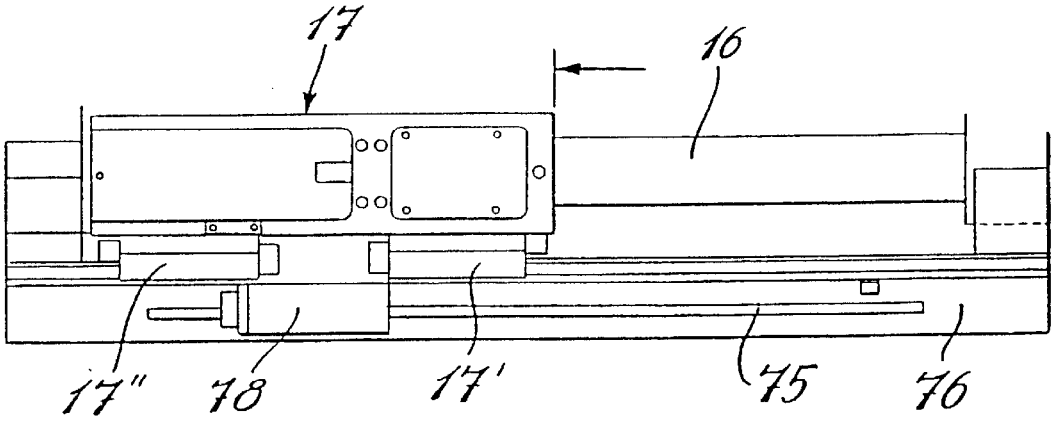
FIG. 6 is a side view showing the construction of the slide and carriage assembly of the reciprocating linear bagger.

FIG. 6 shows a detailed diagram of the linear drive apparatus and as previously described it consists of a slide support rod 16 which is a cylindrical rod of circular cross-section which is magnetized, and a pair of coils disposed in a housing 17' and 17". As shown in FIG. 6, an encoded scale 75 is also disposed along the support base 76 of the linear drive with the support base being secured to the frame 19. An encoder reader device 78 is secured to the block 17 and displaceable therewith and over the encoded scale 75 for sensing the position of the block along the thrust rod 16. By programming these positions, the length of the forward stroke as well as the rearward stroke can be adjusted and programmed. It is pointed out that by providing this type of linear drive it is possible to position the scoops 27 and 33 at precise locations past the side edge of the infeed conveyor whereby to adapt the reciprocating linear bagger to various different types of bag forming and dispensing machines or bag retaining wicket assemblies. This makes the high speed linear bagging machine of the present invention compatible with various other types of baggers, such as roll stock baggers available in the industry. The linear drive also achieves high precision and stability required to position the scoops at exact locations within an open bag wherein to achieve positive and reliable engagement.

As shown in FIG. 1, the product receptacle 24 is disposed at a rearward inclined position immediately above a guide plate 80 whereby when the sliced bread loaf 14 is discharged therein it will be rearwardly inclined and maintained in stable position. When it is released the bagged loaf will fall onto the guide plate 80 and be deposited at the inlet of the discharge conveyor 12. As also shown in FIG. 1, a tensioning roll 81 provides for the adjustment of the tension in the conveyor belt 82 of the infeed conveyor.

As shown with additional reference to FIG. 3, it can be seen that the pneumatic blockade assembly 42 is comprised of a pivotal arm 85 which is substantially L-shaped and provided with a crank arm 86 which is pivotally connected at 87 to a piston rod 88 of piston 89. The actuation of this piston is again controlled by the control computer and it causes the abutment plate 44 to be positioned against the end 14' of the sliced bread loaf when positioned in the product receptacle 24. The end plate 44 is disposed in axial alignment with the slide support rod 16 which lies on the longitudinal axis 90 at the reciprocating linear bagger. The operation of the piston 89 is synchronized with the operation of the linear bagger and with the sensor 63 at the discharge end of the infeed conveyor. As previously described the pneumatic blockade assembly 42 is secured to the frame 19 adjacent the bagging station 24.

As can be seen in FIG. 7, an air jet 91 is disposed at an angle relative to the abutment plate 44 to cause folding displacement of the free end section 40" of the open end of the bag 40, which extends beyond the end 14' of the sliced loaf, against the end 14' of the loaf during the transfer of the bag product from the bagging station 24 onto the guide slide 80 and onto the end of the discharge conveyor 12 to prevent the end slices of the loaf from falling. This air jet is also synchronized by the control computer. It also prevents the film of the bag at the open end from entangling with the abutment plate 44 during its withdrawing cycle.

Figure 9:
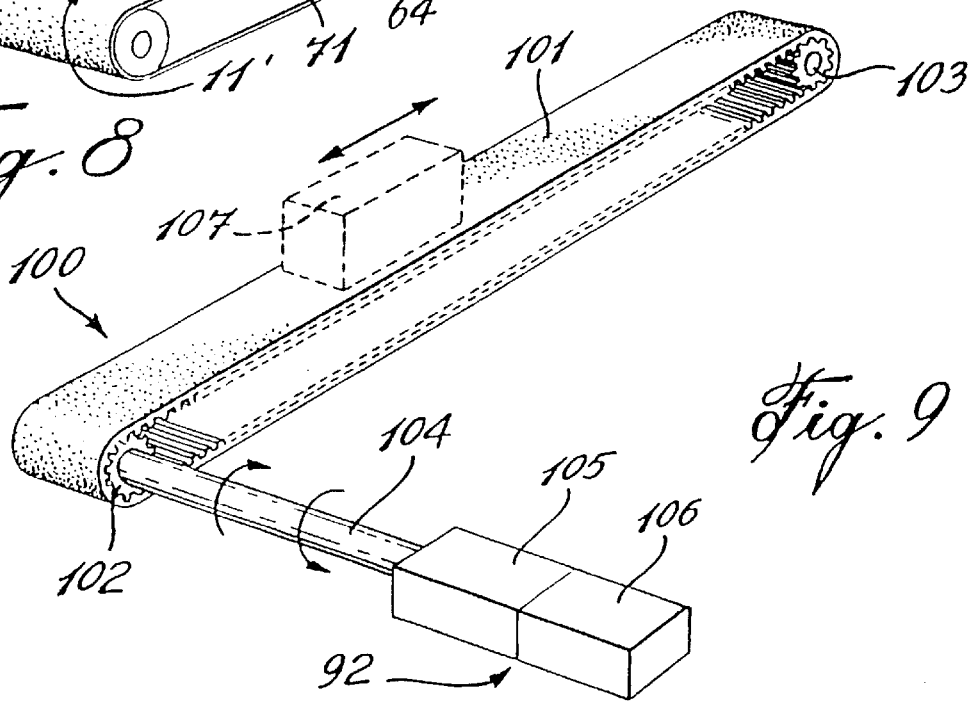
FIG. 9 is an alternative construction of the linear drive of the reciprocating linear bagger and wherein the carriage is mounted on a link belt which is driven by the stator thrust rod which is axially rotated by the pair of coils whereby to axially rotate the rod in a clockwise and counter-clockwise direction.

Referring now to FIG. 9 there is shown generally at 100 an alternate construction of the linear drive. As hereinshown, the straight slide is provided by a timing belt 101 which is engaged between a drive sprocket 102 and an idle sprocket 103. The timing belt 101 is well known in the art but in this specific application the drive sprocket is secured to the end of the thrust rod 104 of a rotary motor 92, well known in the art. The rod 104 is a rotor rod and the coils 105 and 106 form the stator magnetic material, as is well known. The pair of coils are herein housed in housings which are immovably connected to the machine frame 19 as shown in FIG. 1. These coils, when energized by passing a current therethrough, impart a clockwise or a counter-clockwise axial rotation to the rod 104, respectively, whereby to drive the belt 101 in a reciprocating manner so that the carriage 107 can be reciprocated.

The stroke lengths are also adjustable as previously described. The reciprocating linear bagger assembly 15 as previously described is connected to this carriage and the same operation is obtained. The purpose of locating the linear drive in substantially the same plane as the belt, is that it eliminates imbalance in the machine and hence greatly reduces vibrations and achieves precision to locate the scoops within the mouth opening of the bag to be engaged at the bagging station.

Summarizing the method of operation, it consists of transporting a product to be bagged, herein a sliced bread loaf, on an infeed conveyor to a bagging station. The product is detected by a sensor which signals a control computer concerning its position and this initiates the forward stroke of a reciprocating linear bagger along a straight forward stroke of predetermined length whereby to position a product receptacle at a bagging station to receive the product, herein the sliced bread loaf. Simultaneously the open end of a bag, at a bag dispensing station, is engaged by a pair of scoop arms. These scoop arms open the bag and tension the bag by applying regulated pressure to an articulated one of the scoop arms. A product arresting plate is then positioned to abut the first end of the loaf discharged in the product receptacle and axially opposite to the engaged bag open end. The linear bagger is then displaced through its rearward stroke to draw the open end of the engaged bag over the product from an opposed end of the product. The air in the bag prevents the other end of the sliced loaf from separating and applies pressure against the product in the discharge stroke. The bag product is then discharged on a discharge conveyor and the product arresting means is withdrawn. When the next bread loaf is detected the cycle is repeated.

With the linear drive utilized with the apparatus of the present invention and with the improved scoop assembly and pneumatic blockade assembly there is provided an apparatus with increased reliability and higher speed operation. The apparatus also provides for adjustable scoop stroke lengths as well as variable scoop open and closed positions which can be preadjusted to suit the parameters of the product to be bagged as well as the parameters of its associated bag. The apparatus also permits the programming and synchronization of the entire process. Furthermore, because of the direct drive coupling between the infeed and discharge conveyor, it is possible to achieve high accuracy at high speed, that is to say, at bagging speeds of from 60 to 70 articles per minute.

What is claimed is:

1. A method of bagging a product comprising the steps of:

i) transporting a product to be bagged on an infeed conveyor to a bagging station, ii) detecting said product and signaling a control means of its position prior to said bagging station, iii) displacing a reciprocating linear bagger along a straight predetermined forward stroke to position a product receptacle at said bagging station to receive said product thereon and to simultaneously engage an open end of a bag at a bag dispensing station by a pair of scoop elements, iv) tensioning said open end of said bag by applying regulated pressure to an articulated one of said scoop elements, v) applying a product arresting means in abutting relationship with a first end of said product discharged on said product receptacle and axially opposite said engaged bag open end, vi) displacing said reciprocating linear bagger through a predetermined rearward stroke to draw said open end of said engaged bag over said product from an opposed end of said product, vii) discharging said product positioned in said bag on a discharge conveyor, viii) withdrawing said product arresting means from its arresting position with said product, said steps (iii) and (vi) comprising displacing said linear bagger on a carriage displaceable along a straight thrust rod of magnetic material constituting a stator of a linear motor, a pair of coils associated with said carriage and being energized by control means to cause said carriage to be displaced along said thrust rod in a forward and reverse direction.

2. A method as claimed in claim 1 wherein there is further provided initial set-up steps of:

a) programming the length of said forward and rearward stroke of said reciprocating linear bagger dependent on the position of said bag dispensing station, and b) programming the pressure applied to a tensioning device associated with said articulated one of said scoop elements dependent on bag parameters, and c) synchronizing the speed of said reciprocating linear bagger with said infeed and outfeed conveyors.

3. A method as claimed in claim 2 wherein said product is a sliced bread loaf, said step (vi) comprising applying air pressure against an end slice of said sliced bread loaf at said opposed end by air captive in said bag as it is withdrawn over said sliced bread loaf to prevent said sliced bread loaf from separating.

4. A method as claimed in claim 3 wherein there is further provided the step of detecting the speed of an infeed conveyor and synchronizing the speed thereof with said discharge conveyor and a bread slicer machine.

5. A method as claimed in claim 3 wherein after step (vi) and prior to step (vii) there is provided the further step of applying an air stream against a protruding end section of said bag positioned about said sliced brad loaf to prevent said sliced bread loaf from separating during the transfer thereof to said discharge conveyor.

6. A method as claimed in claim 3 wherein there is further provided the initial steps of adjusting the position of guide rails associated with said infeed and outfeed conveyors to precisely position said sliced bread loaf relative to said product receptacle and to a bag open end closure station.

7. A method as claimed in claim 1 wherein there is further provided the step of detecting a forward edge of said product at a predetermined position along said infeed conveyor and actuating an air jet to open a bag positioned at said bag dispensing station.

8. A method as claimed in claim 7 wherein there is further provided the step of detecting the position of a portion of said open end of said bag to determine that said bag is in fact open, and feeding a signal to said control means when said bag is not in an open position to effectuate a stoppage of said linear bagger and said conveyors and associated machines.

9. A high speed linear bagging machine comprising a product carrying infeed conveyor for transporting a product to be bagged to a bagging station, a discharge conveyor adjacent said bagging station for transporting a bagged product, a reciprocating linear bagger assembly having a straight drive member, a carriage connected to said straight drive member, drive means having a pair of coils to impart a drive to said straight drive member to displace said carriage, stroke control means for controlling said coils dependent on a desired forward and rearward displacement stroke of said carriage along said drive member, a product receptacle secured to said carriage and displaceable to said bagging station, bag engaging means connected to said carriage, product arresting means displaceable for abutting relationship with an end of said product at said bagging station, said bag engaging means engaging an open end of a bag at a forward end of said displacement stroke adjacent said bagging station and withdrawing said open end of said bag over said product which is maintained substantially stationary by said product arresting means during a reverse stroke of said carriage whereby to insert said product in said bag and discharge said bagged product from said product receptacle, detection means associated with said infeed conveyor and said control means to detect the position of said product, said infeed and discharge conveyor having a common synchronized drive feeding a speed indicator signal to said control means to synch said reciprocating linear bagger with said conveyors, said drive member being comprised by a straight thrust rod of magnetic material constituting a stator of a linear motor, and said pair of coils being connected to said carriage and being energized for displacing said carriage along said thrust rod to cause displacement of said carriage.

10. A high speed linear bagging machine as claimed in claim 9 wherein said bag engaging means is further provided with tension adjustment means to control the engagement pressure of said bag engaging means with a bag engaged thereby and dependent on the cross-sectional area of said bag and the nature of the material from which said bag is made of.

11. A high speed linear bagging machine as claimed in claim 10 wherein said bag engaging means is comprised by a pair of spaced-apart arms each having a scoop formation at their free ends, a lower one of said scoop formations being constituted by a forward projection of a bottom support wall of said product receptacle, an upper one of said scoop formations being spaced a predetermined distance above said lower arm and mounted on a piston displaceable frame for vertical displacement thereabove, said upper scoop formation being pivotally secured to said piston displaceable frame by a pivot connection, and an adjustable control to control the arcuate displacement of said upper arm and upper scoop formation with respect to said pivot connection.

12. A high speed linear bagging machine as claimed in claim 11 wherein a rear end of said upper arm is connected to a piston rod end of a pneumatic cylinder, said adjustable control adjusting the pressure fed to said cylinder to thereby control the arcuate displacement of said upper arm.

13. A high speed linear bagging machine as claimed in claim 12 wherein said bag is a plastic bag, said lower and upper arms entering said open end of said bag and said upper arm being displaced by said piston displaceable frame to contact opposed side wall portions of said bag, said upper arm being pivoted to stretch said open mouth opening to a convenient cross-sectional area to positively engage said bag and to clear said product as it is pulled thereover.

14. A high speed linear bagging machine as claimed in claim 11 wherein said upper one of said arms is adjustably secured to said piston displaceable frame and dependent on the cross-sectional area of said bag to be engaged which in turn is dependent on said product cross-sectional area.

15. A high speed linear bagging machine as claimed in claim 11 wherein said piston displaceable frame is secured to one or more piston rods which are automatically extended at a predetermined position of said forward piston stroke by said control means.

16. A high speed linear bagging machine as claimed in claim 11 wherein said product receptacle has said bottom thereof secured at a rear inclined angle, and a transverse abutment wall secured to said bottom support wall for abutting support retention of said product.

17. A high speed linear bagging machine as claimed in claim 10 wherein said product arresting means is a pneumatic blockade assembly comprising a pivotal arm having an arresting plate at a free end thereof, said arm having a connection with a piston rod end of an actuation piston to displace said arresting plate against a rear end of said product, said bag open end being pulled over said product from a forward end of said product.

18. A high sped linear bagging machine as claimed in claim 17 wherein said pivotal arm is a right angle arm pivotally secured to one side of said straight thrust rod adjacent said bagging station, and an air jet disposed relative to said abutment plate for causing displacement of a free end section of said open end of said bag, which extends beyond a rear end of said product, against said end of said product engaged by said blockade assembly during the transfer of said bagged product from said bagging station to said discharge conveyor to prevent said product which is a sliced bread from separating at said rear end.

19. A high speed linear bagging machine as claimed in claim 10 wherein said detection means associated with said infeed conveyor comprises a first sensor secured relative to said infeed conveyor to detect a leading edge of said article transported by said infeed conveyor, said first sensor initiating the forward stroke of said linear bagger, said infeed conveyor transporting a plurality of said articles at predetermined intervals.

20. A high speed linear bagging machine as claimed in claim 19 wherein said detection means further comprises a second sensor secured relative to said infeed conveyor to detect a leading edge of said article and actuating an air jet to blow open a forward open end of a collapsed bag to be engaged and transferred by said bag engaging means.

21. A high speed linear bagging machine as claimed in claim 19 wherein said detection means further comprises a third sensor secured relative to said infeed conveyor to detect a leading edge of said article to synchronize the speed of an article feeding machine with the speed of said infeed conveyor.

22. A high speed linear bagging machine as claimed in claim 21 wherein said article is a sliced bread, said article feeding machine being a bread slicing machine, said infeed conveyor having adjustable guide walls to prevent said sliced bread from separating.

23. A high speed linear bagging machine as claimed in claim 10 wherein there is further provided sensor means to detect that said bag is open at a bag engaging position adjacent said bagging position and to a side of said conveyor opposed to a side where said straight thrust rod is mounted, said straight thrust rod being disposed at right angles to a longitudinal axis of said conveyors.

24. A high speed linear bagging machine as claimed in claim 9 wherein a first of said coils controls the forward stroke displacement distance of said carriage, a second of said coils controls the rearward stroke displacement distance of said carriage, said stroke control means applying a controlled current to each said coils for a predetermined duration.

25. A high speed linear bagging machine as claimed in claim 9 wherein said common synchronized drive comprises a motor and gear box, a pair of drive sprockets connected to an output shaft of said gear box and to respective driven sprockets of said infeed and discharge conveyor, and an infeed phase adjuster to precisely position pusher bars associated with said infeed conveyor at a product discharge location to synchronize same through said control means with said reciprocating linear bagger.

26. A high speed linear bagging machine as claimed in claim 9 wherein a thrust block is slidingly displaceable along said thrust rod by said coils housed therein, said thrust block constituting said carriage, an encoded scale provided on a support base of said thrust rod, and an encoder reader secured to said thrust block and displaceable therewith and over said scale for sensing the position of said block along said thrust rod.

27. A high speed linear bagging machine as claimed in claim 9 wherein said straight drive member is a timing belt having a drive sprocket secured to a thrust rod end of a rotary motor, said rod being a stator rod constructed of magnetic material, said pair of coils being disposed in housings immovably connected to a machine frame, said coils imparting clockwise and counter-clockwise axial rotation, respectively, to said rod to drive said belt in a reciprocating manner, said carriage being secured to said belt, said belt and said rotary motor lying substantially in a common horizontal plane.

* * * * *